US011248514B2

(12) United States Patent
Palmisani et al.

(10) Patent No.: US 11,248,514 B2
(45) Date of Patent: Feb. 15, 2022

(54) LIQUID-COOLED INTERNAL COMBUSTION ENGINE

(71) Applicants: Liebherr Machines Bulle SA, Bulle (CH); Deere & Company, Moline, IL (US)

(72) Inventors: Domenico Palmisani, Bulle (CH); Raghavendra Hedge, Fribourg (CH); Zhi Li, Bulle (CH); Michael Sullivan, Waterloo, IA (US)

(73) Assignees: Liebherr Machines Bulle SA, Bulle (CH); Deere & Company, Moline, IL (US)

( * ) Notice: Subject to any disclaimer, the term of this patent is extended or adjusted under 35 U.S.C. 154(b) by 0 days.

(21) Appl. No.: 16/852,633

(22) Filed: Apr. 20, 2020

(65) Prior Publication Data

US 2020/0318525 A1 Oct. 8, 2020

Related U.S. Application Data

(63) Continuation of application No. 15/926,346, filed on Mar. 20, 2018, now Pat. No. 10,662,857.

(30) Foreign Application Priority Data

Mar. 22, 2017 (CH) ..... 00388/17

(51) Int. Cl.
*F01P 3/02* (2006.01)
*F01P 3/14* (2006.01)
(Continued)

(52) U.S. Cl.
CPC ..... *F01P 3/02* (2013.01); *F01P 3/14* (2013.01); *F02F 1/14* (2013.01); *F02F 1/16* (2013.01);
(Continued)

(58) Field of Classification Search
CPC ..... F01P 3/02; F01P 2003/028; F01P 3/14; F01P 3/16; F01P 2003/021;
(Continued)

(56) References Cited

U.S. PATENT DOCUMENTS 3,889,644 A 6/1975 Moore
4,200,065 A 4/1980 Buddenhagen
(Continued)

FOREIGN PATENT DOCUMENTS

BE 533709 A 12/1954
DE 69208821 T2 8/1996
(Continued)

OTHER PUBLICATIONS

Iwasaki, WO 2015/194143, machine translation (Year: 2015).*
(Continued)

*Primary Examiner* — Hung Q Nguyen
*Assistant Examiner* — Mark L. Greene
(74) *Attorney, Agent, or Firm* — Dilworth & Barrese, LLP

(57) ABSTRACT

The present invention relates to a liquid-cooled internal combustion engine comprising an engine block, which includes a plurality of cylinders, and cylinder heads closing the cylinders, wherein each cylinder is surrounded by a respective cooling liner and each cylinder head has provided therein at least one separate cooling chamber connected to the cooling liner of the associated cylinder via at least one transition channel, wherein the transition channels of at least two cylinders are interconnected via a pressure compensation chamber.

22 Claims, 11 Drawing Sheets

(51) Int. Cl.

| | |
|---|---|
| ***F02F 1/14*** | (2006.01) |
| ***F02F 1/16*** | (2006.01) |
| ***F02F 1/38*** | (2006.01) |
| *F01P 3/16* | (2006.01) |

(52) U.S. Cl.
CPC ..... *F02F 1/38* (2013.01); *F01P 3/16* (2013.01); *F01P 2003/028* (2013.01)

(58) Field of Classification Search
CPC ..... F01P 2003/024; F02F 1/16; F02F 1/14; F02F 1/36; F02F 1/38
See application file for complete search history.

(56) References Cited

U.S. PATENT DOCUMENTS

| | | | | |
|---|---|---|---|---|
| 4,305,348 | A | 12/1981 | Martin | |
| 5,983,843 | A | 11/1999 | Suzuk et al. | |
| 8,662,028 | B2 * | 3/2014 | Knollmayr | F02F 1/40 123/41.82 R |
| 9,212,620 | B2 | 12/2015 | Berkemeier | |
| 2011/0277708 | A1 | 11/2011 | Geiser et al. | |
| 2015/0211408 | A1 * | 7/2015 | Maier | F02F 1/38 123/41.77 |

FOREIGN PATENT DOCUMENTS

| | | | |
|---|---|---|---|
| DE | 10244829 | A1 | 4/2004 |
| DE | 10251360 | A1 | 5/2004 |
| DE | 102005026599 | A1 | 12/2006 |
| DE | 102007048021 | A1 | 4/2009 |
| DE | 102011015930 | A1 | 10/2012 |
| DE | 102014118060 | A1 | 6/2015 |
| EP | 1052394 | A2 | 11/2000 |
| JP | 56143312 | A | 11/1981 |
| WO | 2010/025610 | A1 | 3/2010 |
| WO | 2015/194143 | A1 | 12/2015 |

OTHER PUBLICATIONS

Soengen, DE 102005026599, machine translation. (Year: 2006).*
Vogt, DE 102011015930, machine translation (Year: 2012).*
Jitsuzawa, JP S56-143312, machine translation (Year: 1981).

* cited by examiner

LIQUID-COOLED INTERNAL COMBUSTION ENGINE

BACKGROUND OF THE INVENTION

The present invention relates to a liquid-cooled internal combustion engine comprising an engine block, which includes a plurality of cylinders, and cylinder heads closing the cylinders, wherein each cylinder is surrounded by a respective cooling liner and each cylinder head has provided therein at least one separate cooling chamber connected to the cooling liner of the associated cylinder via at least one transition channel.

For cooling an internal combustion engine during engine operation, a suitable coolant flows through the engine. Due to a cooling liner surrounding the cylinder sleeves installed in the cast part of the engine block, coolant flows around the cylinder sleeves. Also the cylinder heads comprise one or more cooling chambers for cooling the valves, gaskets, etc. accommodated therein. Normally, an external coolant pump is used for pumping the coolant through the cooling liners, cooling chambers and channels of the individual cylinders.

A possible cooling concept for an internal combustion engine is known from EP 2 132 423 B1. The flow pattern according to the prior art is schematically shown in FIG. 1. Each of the total number of four cylinders of the engine block 1 is closed via a single cylinder head 3. The cooling liners of the cylinders are identified by reference numeral 2. Starting from a common coolant distribution chamber 5, the coolant is first subdivided into partial flows through the individual cooling liners 2 of the cylinders of the engine block 1. The coolant flows from each cooling liner 2 through a separate riser 6 into first and second cooling subchambers 7*a*, 7*b* of the respective cylinder head 3. At the end, the coolant of the partial flows is collected in a common coolant collecting chamber 8.

Ideally, the partial flows of coolant distributed to the individual cylinders should be identical and pressure losses should be kept low. However, manufacturing tolerances in the casting process for producing the engine block 1 and the cylinder heads 3 and the cylinder head bank 200 lead to minor deviations of the actually existing geometries of the cooling liners, cooling chambers and cooling channels, which deviations are already application relevant and may cause asymmetric partial flows with deviating coolant flow rates. Furthermore, when the supply of coolant into the distributing chamber and the discharge of the coolant from the collecting chamber are inclusively taken into account, the flow paths to be assigned to the individual cylinders are not identical. The asymmetries require, all in all, a higher coolant circulation rate, so as to guarantee sufficient cooling of all combustion chamber surroundings.

Up to now, this has been remedied by modifying the cylinder head gaskets, which are identified by reference numeral 4 in FIG. 1. These cylinder head gaskets comprise, inter alia, openings for the coolant transition channels 6, 9 between the engine block 1 and the cylinder head 3. By adapting the gasket elements 4*a*, 4*b* in the areas of the channels 6, 9, individual flow resistances can be realized, whereby a flow rate adaptation of the various partial flows of coolant can be accomplished in the final analysis. This measure will also be necessary when the upper or lower cooling chambers 7*a*, 7*b* are in direct fluid communication with one another.

The suggested course of action is, however, disadvantageous insofar as it requires first a complicated analysis of the symmetry characteristics of the internal combustion engine produced. In addition, the necessity of providing cylinder-specific gaskets is not particularly economical.

SUMMARY OF THE INVENTION

What is aimed at is therefore a solution, which guarantees uniform flows of coolant through the internal combustion engine, without having to accept the above-mentioned drawbacks.

This object is achieved by a liquid-cooled internal combustion engine according to the features herein. Starting from an internal combustion engine of the generic kind, the present invention suggests that the transition channels of at least two cylinders, i.e. the transition channels connecting the separate cooling chambers per cylinder with the respective cooling liner of the associated cylinder, are interconnected via a common pressure compensation chamber. Through the pressure compensation chamber, the coolant partial flows will be united before they enter the cooling liners, whereby deviations in the coolant flow rates can be balanced. This will render the coolant flow rates for all partial flows identical or almost identical.

The structural design according to the present invention does not require any modifications of the cylinder head gasket. Instead, identical gasket elements can ideally be used for all the cylinders of an internal combustion engine, and, in the final analysis, this leads to an enormous cost saving potential, all the more due to the fact that the above-mentioned complex measurement analysis can be dispensed with.

It will be particularly advantageous to integrate the pressure compensation chamber in the engine block. In particular, said pressure compensation chamber extends in the longitudinal direction of the engine block and, according to a particularly preferred embodiment, it abuts tangentially on the cooling liners of the cylinders. Hence, the transition channels extending from the cooling chamber of the cylinder head terminate in the pressure compensation chamber, which communicates directly with the individual cooling liners of the cylinders of the internal combustion engine block.

According to an advantageous embodiment of the present invention, the flow path of each individual cylinder extends from the at least one cooling chamber of the cylinder head to the cooling liner of the cylinder. It follows that the cooling liner of the cylinder is at the end of the flow path, from which the coolant finally returns to the pressure sink.

According to a specially preferred embodiment, the cylinder head has provided therein at least two separate cooling chambers per cylinder. Ideally, an upper as well as a lower cooling subchamber are provided, the lower cooling subchamber being preferably located in the area of the transition region between the cylinder head and the engine block, i.e. in the area of the flame plate.

It is imaginable that the two cooling chambers are interconnected via at least one connection channel. Better fluid communication will be accomplished by at least two connection channels. A plurality of connection channels may have different diameters. A channel having the larger diameter is preferably used as a main connection between the individual cooling subchambers. The remaining channel with a smaller cross-section is essentially used for the purpose of venting during engine operation. The provision of a second connection channel is additionally advantageous insofar as the formation of airspaces during initial filling of the internal combustion engine with coolant will be avoided.

According to a further advantageous embodiment of the present invention, the cylinder head of at least one cylinder is configured such that an exhaust duct extending through the cylinder head is, at least sectionwise, fully surrounded by the cooling chambers of the cylinder head. In particular, this portion of the exhaust duct is fully surrounded by the upper and lower cooling subchambers as well as by the connection channel or connection channels connecting the subchambers. The heat source in the form of the exhaust duct can thus be shielded effectively in this area of the cylinder head gasket.

The internal combustion engine is preferably equipped with a distributing chamber, which is adapted to be connected to an external pressure source, e.g. a coolant pump, via a pressure connection. The distributing chamber communicates with at least one cooling chamber of each cylinder head via one or a plurality of channels, so that coolant can flow from the distributing chamber into each cylinder head or into at least one cooling chamber of each cylinder head. Hence, the coolant flow is subdivided into individual partial flows, the coolant of each partial flow flowing first through the cylinder head and only subsequently into the engine block, i.e. the cooling liner of the cylinder. According to a preferred embodiment of the present invention, the distributing chamber is integrated in the engine block.

Furthermore, at least one collecting chamber may be provided, in which the individual partial flows of the various cylinders terminate, i.e. the individual cooling liners of each cylinder are connected via one or a plurality of channels to the collecting chamber. The latter may e.g. be provided with a low-pressure connection through which the coolant can be supplied to the part of the coolant circuit located outside the internal combustion engine. Also the collecting chamber may preferably be integrated in the engine block.

According to an advantageous embodiment of the present invention, at least two transition channels are provided per cylinder head, said transition channels extending in parallel from the cylinder head, i.e. the at least one cooling chamber, to the pressure compensation chamber. The provision of two parallel transition channels reduces the pressure losses. The outstanding advantage of this measure is that dead areas of the coolant flow—an area in which no movement of coolant takes place—are avoided, and that a recirculation of the coolant flow—an area in which a movement of the coolant takes place, but no exchange of coolant along the main flow direction occurs—is prevented. The avoidance of such dead areas and recirculation is important, since at the zones where they occur almost no heat removal takes place.

Furthermore, the provision of two parallel transition channels provides structural advantages with respect to the achievable material stiffness of the cylinder head, since in the area between the two parallel transition channels the solid material remains unchanged and is not weakened by a continuous hollow.

According to another preferred embodiment of the present invention, at least one bypass extending from at least one cooling chamber of the cylinder head is provided, which terminates directly in the collecting chamber and circumvents the cooling liner of the cylinder. The provision of one or of a plurality of bypass lines can reduce the risk of further stagnation zones of the coolant flow. Undesirable pressure losses can be limited still further.

Starting from the distributing chamber, the main flow path of the coolant splits up into partial flows for each cylinder, said partial flows being conducted via the upper cooling subchamber of the cylinder head into the lower cooling subchamber, from where the coolant partial flows are reunited by means of the pressure compensation chamber. The coolant of the partial flows accumulating there is again split up into individual partial flows, which flow through the cooling liners of the individual cylinders and are finally reunited in the collecting chamber. The realized coolant flow path is referred to as so-called top-down variant.

An alternative flow pattern is called bottom-up variant. According to this embodiment, the main flow path of the coolant extends for each partial flow from the distributing chamber via the lower cooling subchamber into the upper cooling subchamber. From the upper cooling subchamber, the coolant is conducted via the at least one transition channel to the pressure compensation chamber, which distributes the coolant in identical partial flows to the individual cooling liners of the cylinders. According to the bottom-up variant, the individual partial flows are united in the collecting chamber.

It will be particularly advantageous, when an identity of components with respect to the engine block is obtained for both above-described variants, i.e. for the top-down and for the bottom-up variant. For selecting one of the above-mentioned cooling concepts, it will therefore suffice to exchange the cylinder head. The internal combustion engine block can be used for both variants without any changes.

According to another advantageous embodiment of the present invention, the individual cylinder heads are combined so as to form a cylinder bank, which is advantageously produced as a single cast part.

At least a part of the separate cooling chambers of the cylinder heads may be connected to one another via a separate vent line. In particular the upper cooling subchambers are connected to one another via a vent line. Furthermore, it will be particularly advantageous when this vent line is integrated directly into the cylinder heads or the resultant cylinder bank. By means of the vent line, air bubbles are to be collected and discharged. In addition, also the vent line contributes to a symmetrization of the partial flows, but it cannot replace the function of the pressure compensation chamber, which is essential to the present invention.

According to a further advantageous embodiment of the present invention, the cooling liner of at least one cylinder may be subdivided into at least two cooling liner sections. A subdivision into a lower and an upper liner section, when seen in the longitudinal direction, is particularly advantageous. It will be expedient to connect the two cooling liner sections in parallel with the pressure compensation chamber, so as to reduce the naturally undesired pressure losses. It is also imaginable to connect the cooling liner sections in parallel with the downstream collecting chamber.

Also a direct fluid connection between the cooling liners of neighboring cylinders will be particularly advantageous. The background for this kind of consideration is that, during the expansion phase within a cylinder, the cylinder bushing of said cylinder moves slightly. Taking into account the comparatively small cooling liner thickness, this slight movement already causes a substantial change in the volume conditions prevailing there, and this, in turn, results in the occurrence of pressure pulsations within the coolant partial flow in said cooling liner and, consequently, in a risk of cavitation. By means of the fluid connection in question, these pressure pulsations will be distributed to the neighboring coolant partial flows, thus reducing the amplitudes of the pressure pulsations occurring within a coolant partial flow, whereby, in the final analysis, also the risk that cavitations may occur can be reduced.

BRIEF DESCRIPTION OF THE DRAWINGS

Further advantages and characteristics of the present invention will be explained hereinafter in more detail making reference to two embodiments that are shown in the figures, in which:

FIG. 2*a* shows a schematic representation of a cylinder liner in the cooling volumes;

FIG. 2*b* shows a schematic representation of a distributing chamber in the cooling volumes;

FIG. 2*c* shows a schematic representation of a lower cooling subchamber in the cooling volumes;

FIG. 2*d* shows a schematic representation of an upper cooling subchamber in the cooling volumes;

DESCRIPTION OF THE PREFERRED EMBODIMENTS

In the following, two embodiments of the internal combustion engine according to the present invention are presented, which allow good balancing of the partial flows of coolant through the coolant chambers, channels and liners to be assigned to the individual cylinders of the engine. By means of FIG. 2, the structural design of the coolant chambers, channels and liners will first be illustrated, taking a six-cylinder in-line engine as an example. Two concrete embodiments will then be described making reference to FIGS. 3 to 7 and 8 to 11.

Figure 1:
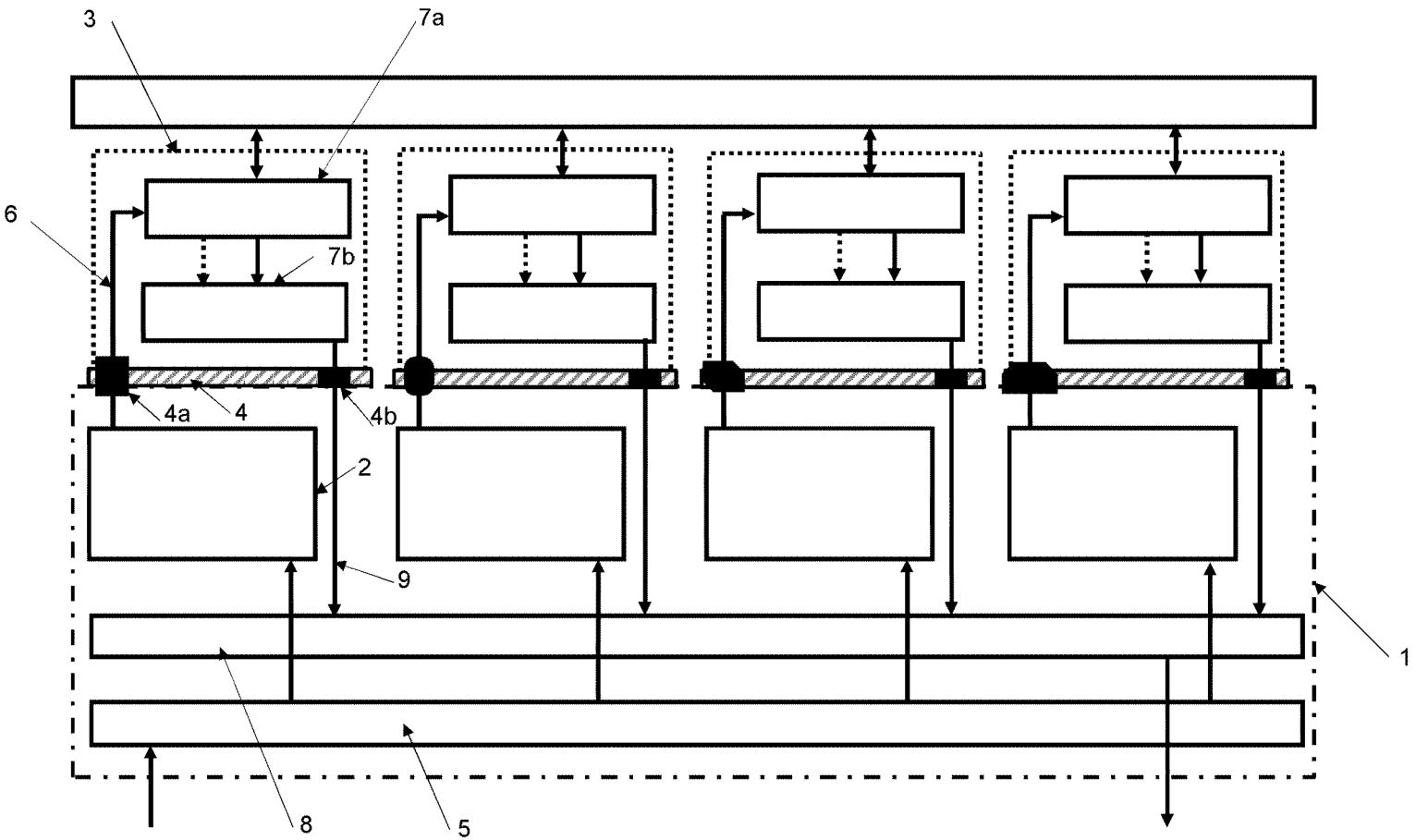
Fig.1 Prior art
FIG. 1 shows a schematic representation of the coolant flow path through an internal combustion engine according to the prior art.
Figure 2:
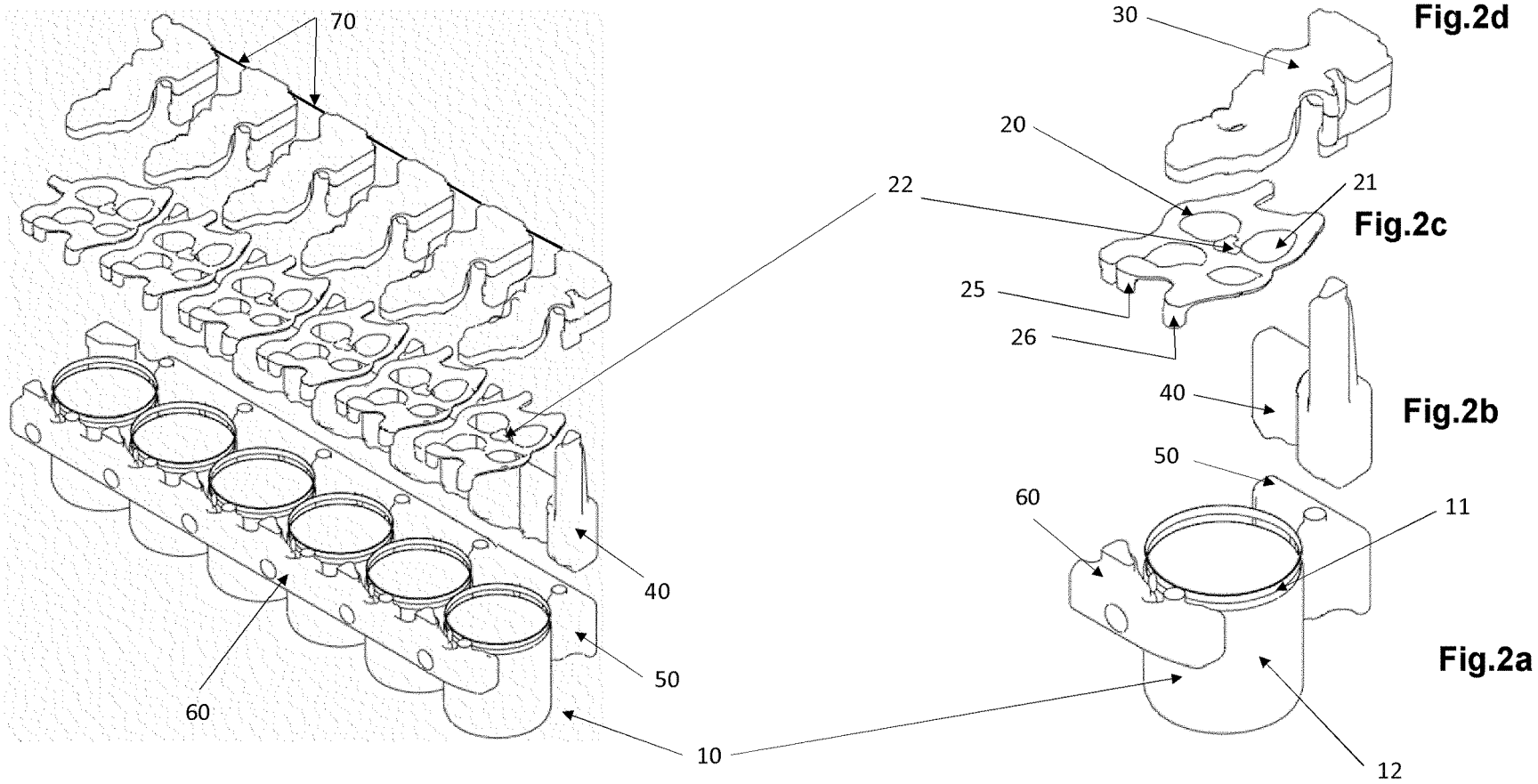
FIG. 2 shows a schematic representation of the cooling volumes of an engine block and a cylinder bank according to the present invention.
Figure 3:
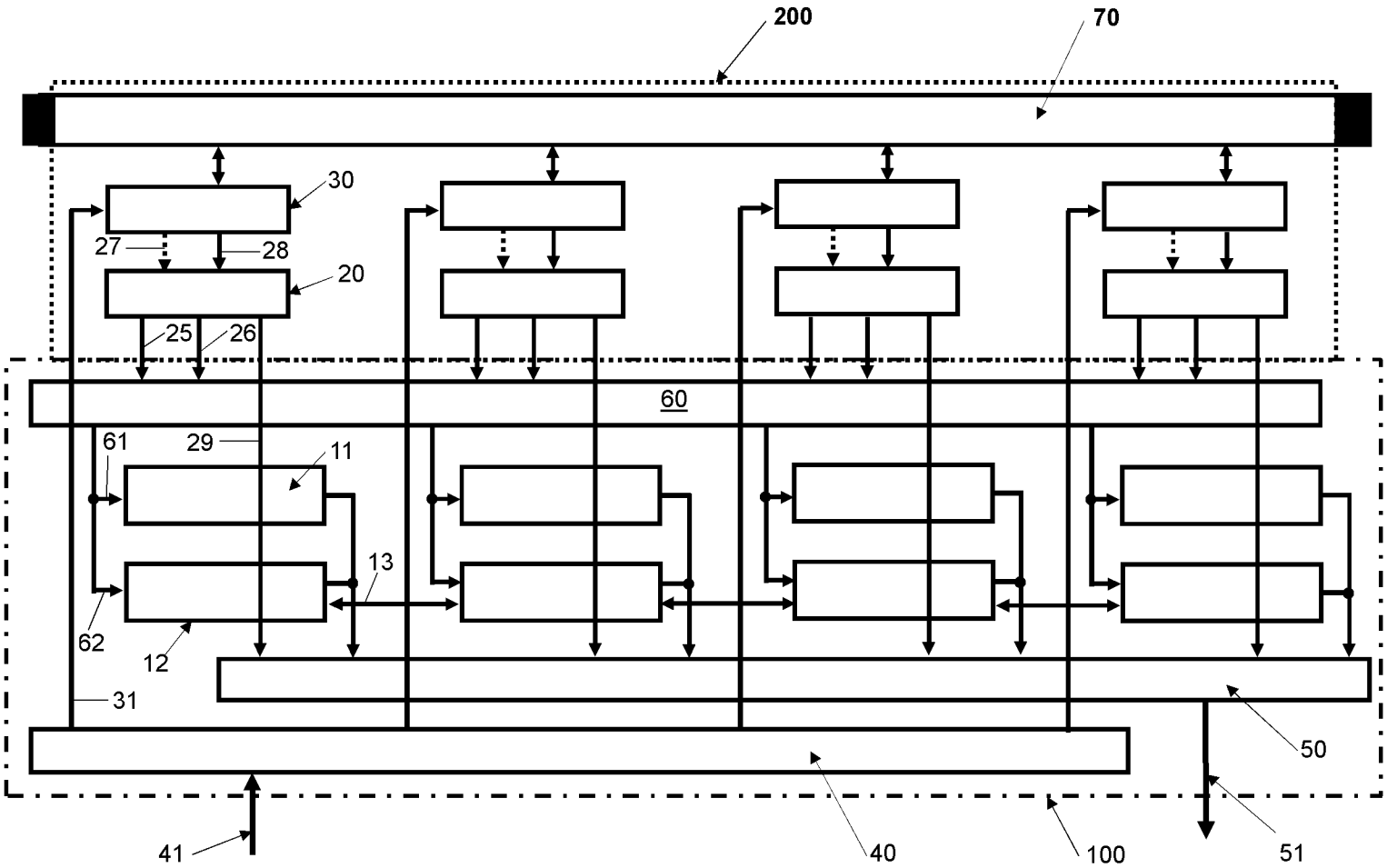
FIG. 3 shows a schematic representation of the coolant flow paths through the internal combustion engine as disclosed by the present invention, according to the top-down concept.

FIG. 2 does not show any structural components of the internal combustion engine according to the present invention, but illustrates only the coolant volumes existing within the engine block and the cylinder head bank when the engine is in operation. Channels, cooling chambers and cooling liners are normally created by suitable openings in the cast part of the engine block or the cylinder bank. The cooling liner for each cylinder is created e.g. by a larger diameter of the cylinder-shaped opening for receiving therein the cylinder sleeve, so that the resultant gap defines the volume in question. A total of six cylinder liners 10 are shown in line.

Each cooling liner 10 is divided into an upper subliner 11 and a lower subliner 12, the volume of the upper cooling subliner 11 being considerably smaller than the volume of the lower cooling liner 12 (cf. FIG. 2*a*). An elongate collecting chamber 50 laterally adjoins the cooling liners 10 of a cylinder bank of the engine block and is fluidically connected in parallel with both cooling subliners 11, 12. On the cylinder side located opposite the collecting chamber 50, a pressure compensation chamber 60 is provided, which also extends along the cylinder bank in the longitudinal direction of the engine block. Also this pressure compensation chamber 60 is in fluid communication with the upper and lower cooling subliners 11, 12.

For each cylinder, a lower cooling subchamber 20 is provided in the cylinder head above the cooling liners 10. A detailed representation is shown in FIG. 2*c*. The four circular openings 21 are conditioned by the valves installed in the cylinder head, in particular by two air intake valves as well as two exhaust valves, around which the coolant of the cooling volume of the cooling subchamber 20 flows. The central opening 22 is conditioned by the sleeve of a fuel injector installed in the cylinder head.

The upper cooling subchamber 30 of the cylinder bank is located thereabove and can be seen in detail in FIG. 2*d*.

Reference numeral 40 stands for the distributing chamber 40 (FIG. 2*b*). The latter additionally extends in a vertical direction up to the upper cooling subchamber 30, so that the coolant contained in the distributing chamber 40 can directly flow, in partial flows, into the upper cooling subchambers 30 of the cylinders. It follows that a top-down cooling concept is here used. The meaning of said concept will be described hereinafter in more detail with reference to the embodiments. In addition, fluid connections 70 between the upper cooling subchambers 30 are recognizable. The resultant vent duct is identified by reference numeral 70.

The individual connections of the coolant volumes and the corresponding flow paths will be discussed hereinafter on the basis of the concrete cooling concepts. The so-called top-down concept of the internal combustion engine according to the present invention is shown exemplarily in FIG. 3 for a four-cylinder engine. The representation shows a cylinder bank of the engine block 100, whose cylinder heads are combined so as to form a cylinder head bank 200. For the sake of simplicity, the reference numerals are only indicated for the first cylinder, the additional cylinders being, however, configured identically with the first cylinder.

Starting from the distributing chamber 40 into which the coolant is pumped via an external pressure connection 41, the coolant is split up into individual partial flows, each of which flows directly into the upper cooling subchamber 30 via a channel 31. The cooling subchambers 30 of the cylinder heads are interconnected via the vent duct 70, whereby air bubbles contained in the coolant can be collected and discharged to the outside. The ends of the vent line are closed by means of end-side caps or provided with a suitable vent valve.

Most of the coolant contained in the upper cooling subchamber 30 of each cylinder flows via a main flow path 28 into the lower cooling subchamber 20. A comparatively small part of the volume flows via the additional fluid connection 27 to the lower chamber 20. Via the second fluid connection 27 additional venting is accomplished when the engine is in operation. In addition, the risk of undesirable accumulations of air in the cooling system, in particular when the engine is put into use, i.e. when the engine is being filled with coolant, can be reduced.

The lower cooling subchamber 20 communicates via two parallel transition channels 25, 26 with the pressure compensation chamber 60. All the partial flows of the individual cylinders are thus reunited in the pressure compensation chamber 60. The existence and the structural design of this pressure compensation chamber 60 leads to good balancing of the cooling system, and production-dependent asymmetries of the channels 28, 31 and of the cooling subchambers 20, 30 are compensated for and almost identical coolant flow rates are obtained for the partial flows of the cylinders. Hence, a largely identical cooling performance is achieved for all the cylinders, whereby the power demand for circulating the coolant will decrease. A modification of the cylinder head gaskets is therefore superfluous. Moreover, the suggested flow pattern allows the asymmetries to be already compensated for to a certain extent through the vent duct 70.

Downstream of the pressure compensation chamber 60, the coolant is again split up into individual partial flows for the individual cylinders and flows via the parallel connection lines 61, 62 to the upper and lower subliners 11, 12 of the cooling liner 10 of the individual cylinders in the engine block 100. After having flown around the cylinder sleeve, the coolant returns into the collecting chamber 50, which delivers the coolant via the pressure connection 51 to the part of the coolant circuit located outside the internal combustion engine. It will be advantageous to feed the upper and lower cooling subliners 11, 12 in parallel from the pressure compensation chamber 60, since a serial connection would entail significantly higher pressure losses because the whole amount of coolant required for cooling the large surface of the lower cooling subliner would have to flow through the upper cooling subliner, which has a much smaller flow cross-section. And the comparatively small flow cross-section of the upper cooling subliner has a length corresponding to half the diameter of the cylinder sleeve.

The lower cooling liners 12 of neighboring cylinders are in fluid communication via the channel 13, so as to distribute the pressure pulsations caused during the expansion phase to neighboring partial coolant flows in order to prevent a development of cavitation damage.

Additionally, the lower cooling subchamber 20 of each cylinder is connected via a bypass channel 29 directly to the collecting chamber 50, whereby a smaller part of the volume of the partial flow will flow past the cooling liner 10 and directly into the collecting chamber 50. Also this measure helps avoiding the risk of dead areas and recirculation of the coolant flow, so as to achieve primarily a reliable and effective cooling and secondarily a reduction of pressure losses.

Figure 4:
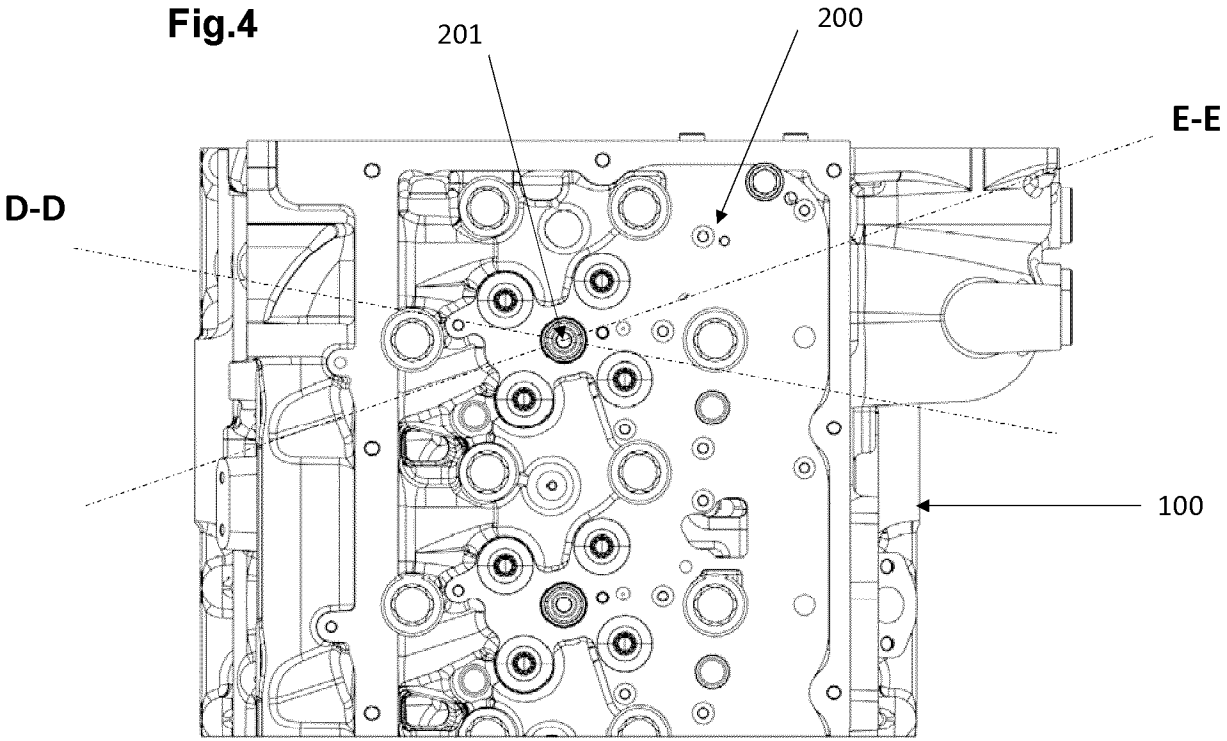
FIG. 4 shows a top view of a subarea of the internal combustion engine according to the present invention.

The sectional views according to FIGS. 5, 6 and 7 through the engine block 100 and the cylinder bank 200 following hereinafter show the concrete characteristics of the individual coolant chambers, liners and channels. The sectional views of FIGS. 5 and 6 cut the engine block on the level of a cylinder in different planes, which are shown in FIG. 4 as sectional planes D-D and E-E.

Figure 5:
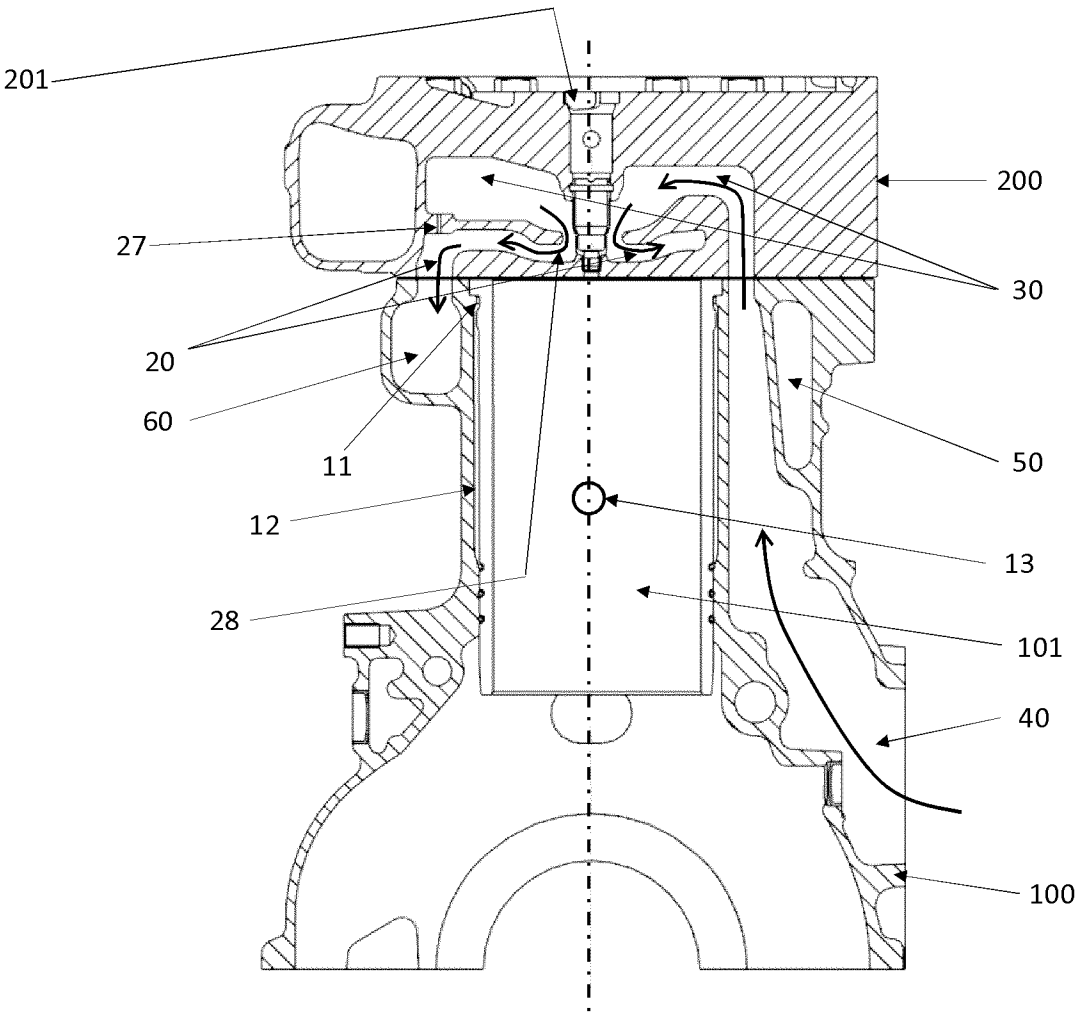
FIG. 5 shows a sectional view according to section axis D-D according to FIG. 4 through the internal combustion engine as disclosed by the present invention, according to the top-down concept.
Figure 6:
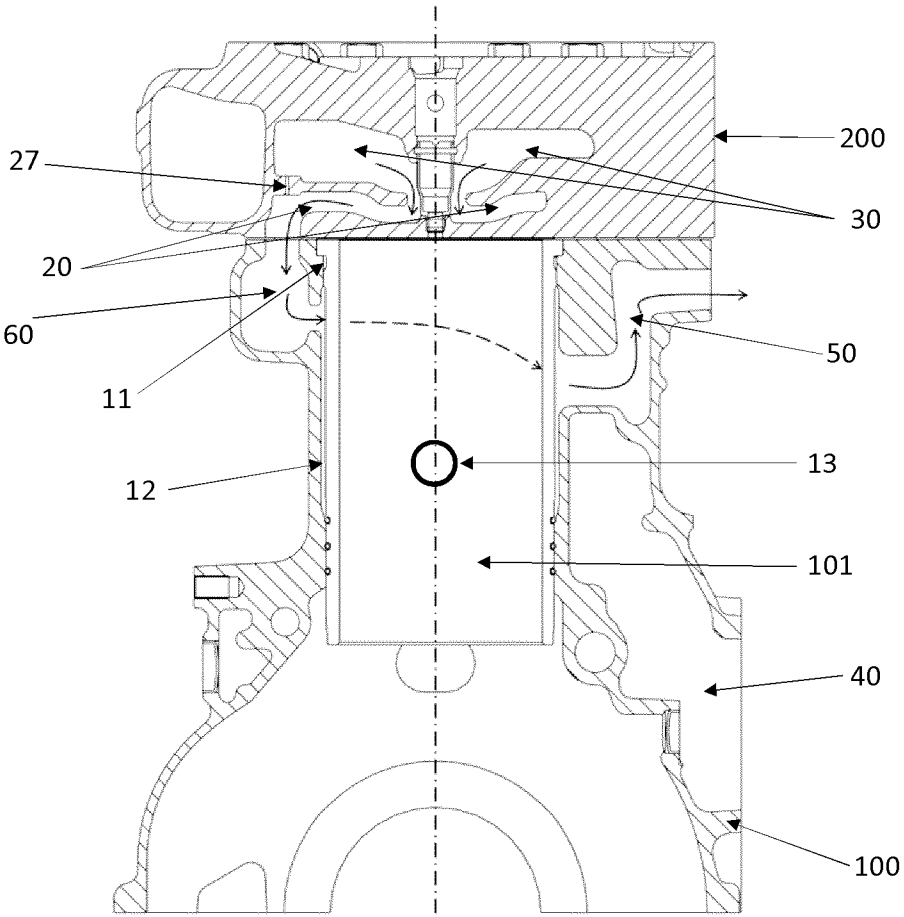
FIG. 6 shows a sectional view according to section axis E-E according to FIG. 4 through the internal combustion engine as disclosed by the present invention, according to the top-down concept.

FIG. 5 shows a section along axis D-D. The cylindrical opening of the engine block 100 has installed therein the cylinder sleeve 101. The gap existing between the opening wall and the sleeve defines the cooling liner, which fully surrounds the cylinder sleeve 101. The opening in the cast part of the engine block 100 has different diameters in a longitudinal direction, whereby the upper and lower cooling subliners 11, 12 are formed. It can here be seen that the lower cooling subliner 12 is much longer, when seen in the longitudinal direction of the cylinder, and that the volume of the cooling subliner 12 is much larger than the volume of the upper cooling subliner 11. In addition, it can be seen that the cross-sectional area of the lower cooling subliner 12 is much larger than that of the upper cooling subliner 11. Furthermore, it can be seen that also the pressure compensation chamber 60 is formed within the engine block 100 and abuts tangentially on the openings for the cylinder sleeves 101 in the direction of the longitudinal axis of the engine block 100.

The cylinder bank 200 attached to the engine block 100 comprises the upper as well as the lower cooling subchamber 20, 30. An installed injector 201 can be seen also in this case. The depicted arrows identify the main flow direction of the coolant flow of a single cylinder. Accordingly, the coolant is conducted from the distributing chamber 40 to the upper cooling subchamber 30 and from there it continues to flow via the main channel 28 to the lower cooling subchamber 20. The second connection line 27 between the upper and lower cooling subchambers 20, 30 is clearly visible, said second connection line having a much smaller diameter.

Via the transition channels 25, 26, only one of which is visible in the sectional plane, the coolant flows into the pressure compensation chamber 60 and from there to the individual cooling subliners 11, 12. The circle on the longitudinal axis of the cylinder sleeve 101 symbolizes the existing fluid connection 13 between the lower subliner 12 and neighboring cooling liners 10. What cannot be seen in the sectional plane D-D is the connection existing between the cooling liners 11, 12 and the collecting chamber 50. This connection can, however, be seen in FIG. 6. Also the necessary connection between the pressure compensation chamber 60 and the cooling liners 11, 12 can here be seen.

Figure 7:
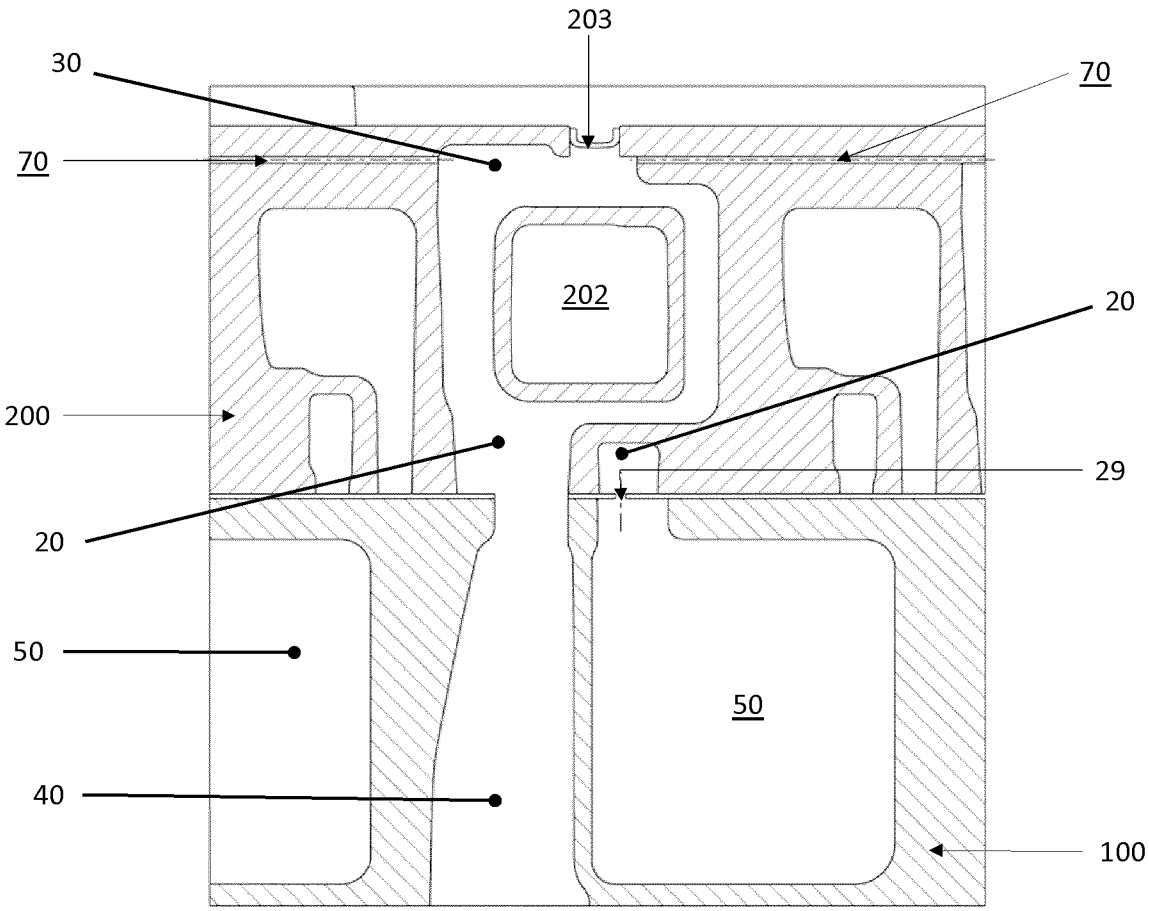
FIG. 7 shows a further sectional view through the internal combustion engine as disclosed by the present invention, according to the top-down principle.
Figure 8:
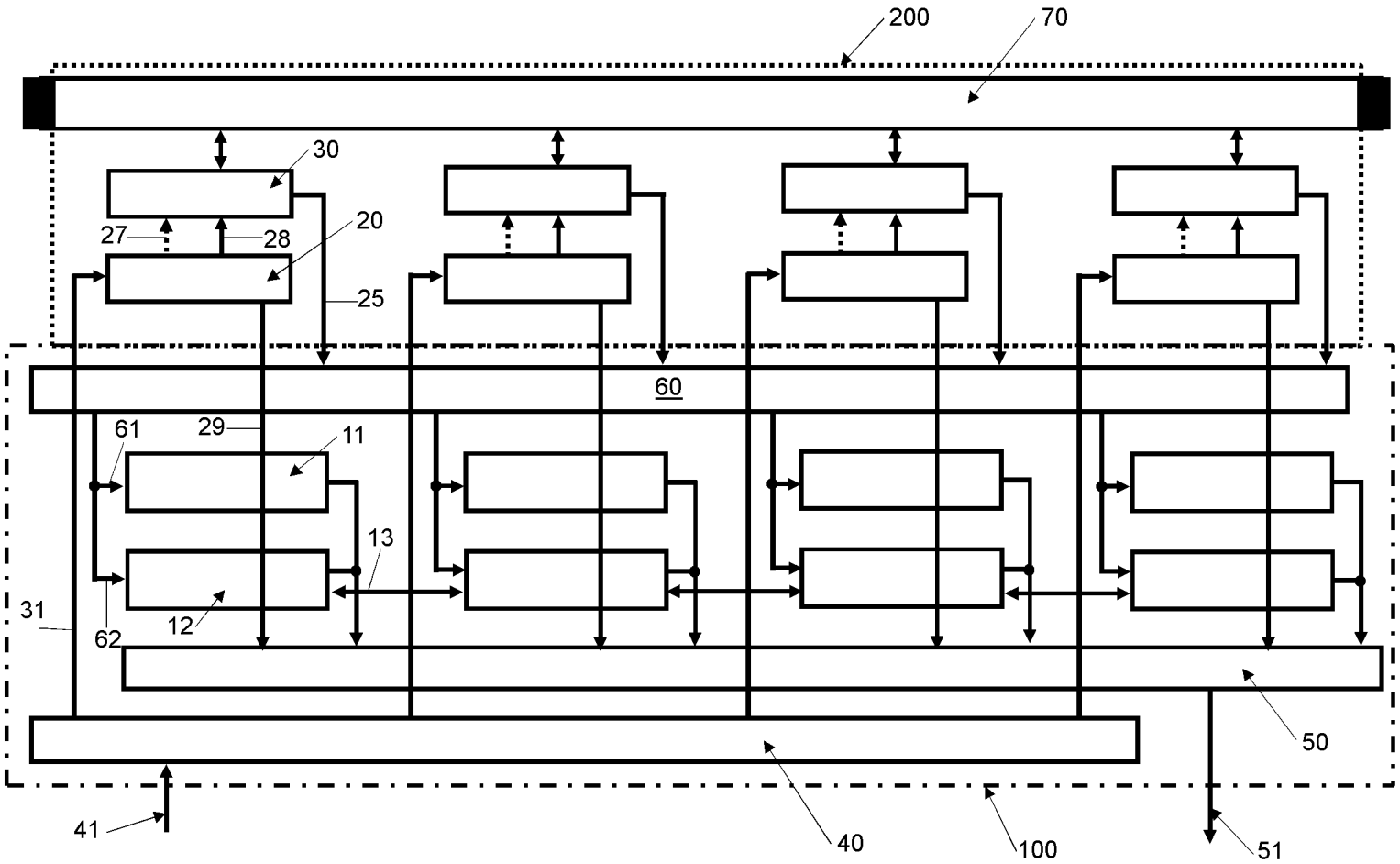
FIG. 8 shows a schematic representation of the flow path pattern of an alternative internal combustion engine as disclosed by the present invention, according to the bottom-up concept.

A further sectional view of the explained cooling concept is shown in FIG. 7. In this plane, a cylinder exhaust duct extending in a transverse direction through the cylinder head bank can be seen in a cross-sectional view, said exhaust duct being, at least sectionwise, fully surrounded by the coolant flow of a cylinder. The upper and lower cooling subchambers 20, 30 as well as the respective channel connections contribute to coolingly surround the exhaust duct 202. The gasket 203 seals the upper cooling subchamber 20 towards the top. FIG. 7 also shows the bypass connection 29 from the lower cooling subchamber 20 to the collecting chamber 50. Likewise, the vent duct 70, which is directly integrated in the cylinder head bank, can be seen.

An alternative cooling concept for the internal combustion engine according to the present invention can be seen from the representations according to FIGS. 8 to 11. For the sake of simplicity, the reference numerals in the representation of FIG. 8, which comprises a total of four cylinders, are only indicated for the first cylinder, the additional cylinders being, however, configured identically with the first cylinder. It goes without saying that also this alternative cooling concept can be transferred to engines having a different number of cylinders, again clearly independently of whether the engine in question is an in-line engine or a V-type engine. Other than in the case of the embodiment according to FIGS. 2 to 7, the coolant does here not flow from the distributing chamber 40 into the upper cooling subchamber 30 of the cylinder head bank 200, but, instead, it flows first into the lower cooling subchamber 20, from where it continues to flow via the connection channels 27, 28 into the upper cooling subchamber 30. The latter communicates via a single transition channel 25 with the pressure compensation chamber 60 from which partial flows to the individual cylinder liners are provided, as is also the case in the first embodiment.

Figure 9:
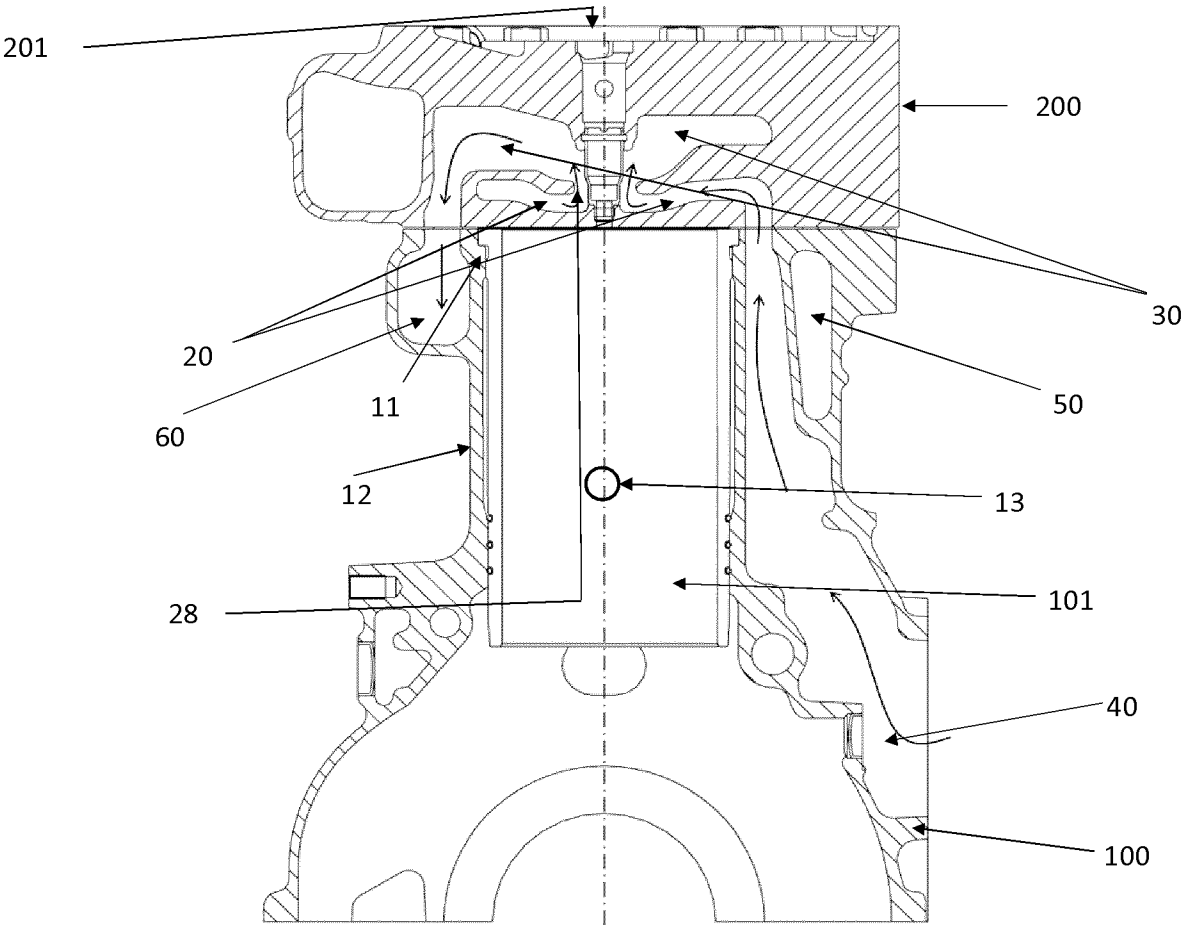
FIG. 9 shows a sectional view through the internal combustion engine according to the bottom-up concept along section axis D-D according to FIG. 4.
Figure 10:
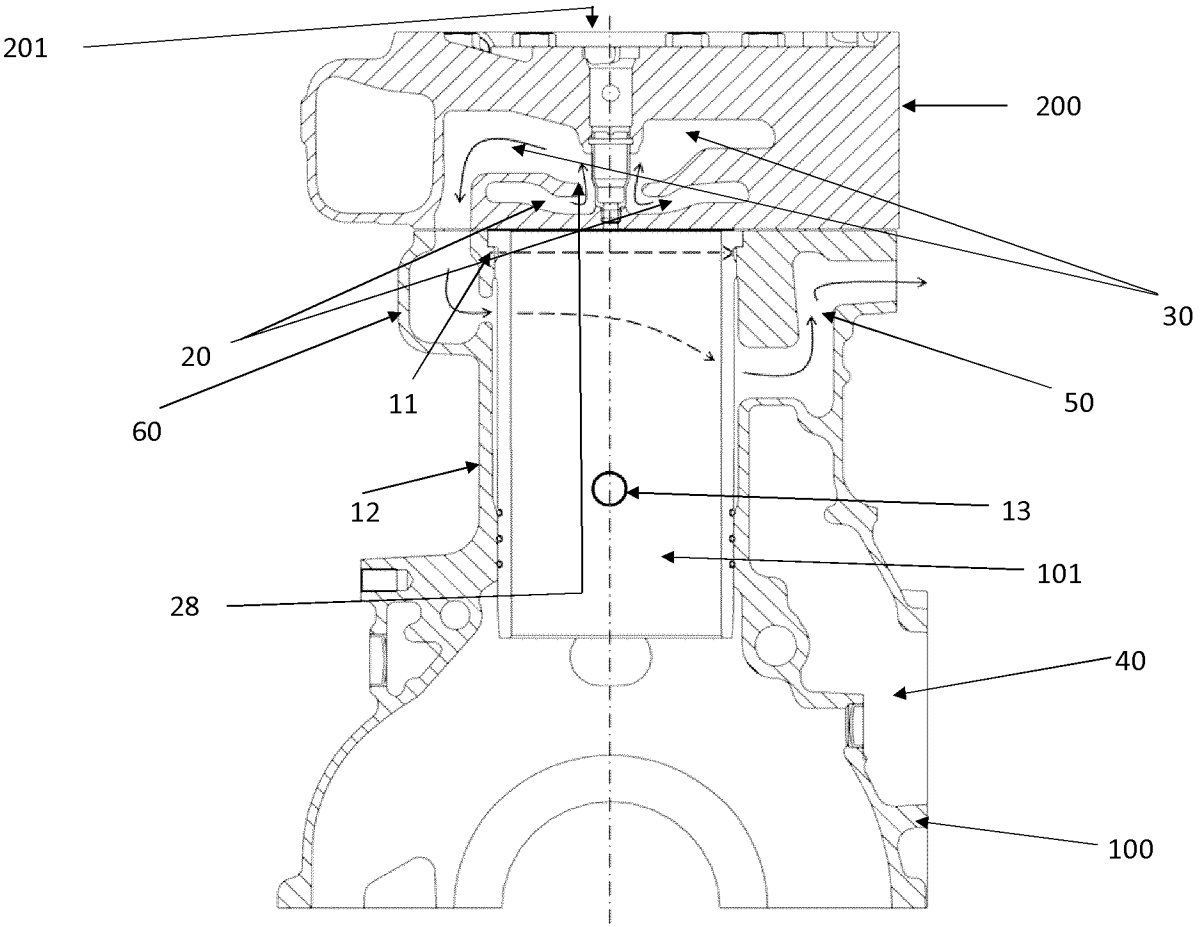
FIG. 10 shows a sectional view along section axis E-E according to FIG. 4 through the internal combustion engine, according to the bottom-up concept.
Figure 11:
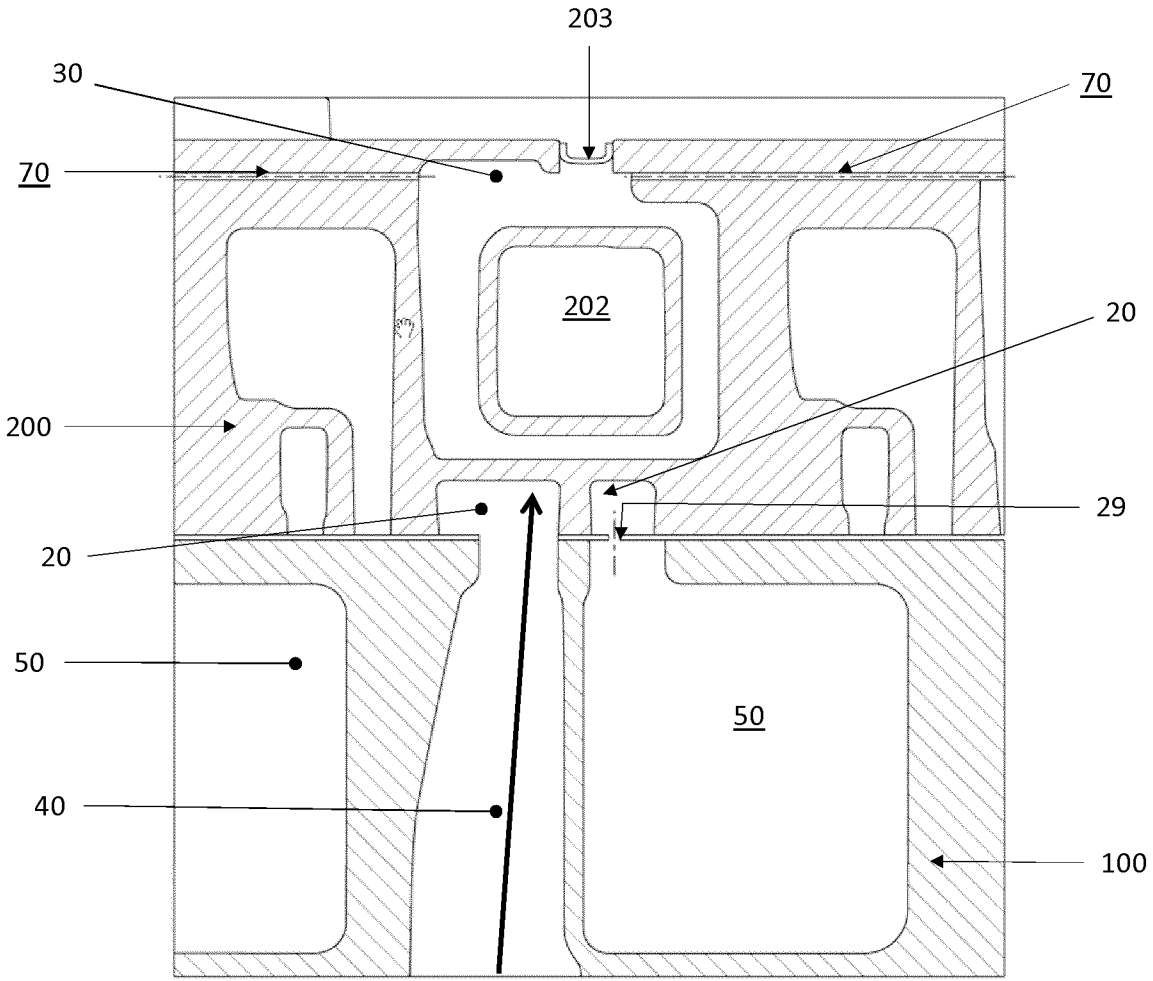
FIG. 11 shows a further sectional view of the internal combustion engine according to the bottom-up concept.

Also in this embodiment, the lower cooling subchamber 20 has a bypass connection 29 to the collecting chamber 50, so that the path via the upper cooling subchamber 30 as well as the cooling liner 10 can be circumvented through said bypass. Also this bypass includes a portion having a comparatively small cross-section. However, this narrow cross-section is only provided over a very short length, whereas the lengths of the flow paths at the cooling subliners of reduced cross-section are many times longer, said flow paths representing a correspondingly high flow resistance. FIG. 9, 10 show corresponding sectional views along the section axes D-D as well as E-E. In comparison with the first embodiment and FIGS. 5 and 6, it can here be seen that the structural design of the engine block 100 is identical, whereas minor differences will be necessary in the cylinder bank 200. It follows that, for using the various cooling concepts and flow patterns, a uniform engine block 100 may be used, and only specific cylinder heads will be necessary.

The invention claimed is:

1. A liquid-cooled internal combustion engine comprising an engine block, which includes a plurality of cylinders, and cylinder heads closing the cylinders, wherein each of the cylinders is surrounded by a respective cooling liner, each of the cylinder heads has provided therein at least one separate cooling chamber connected to the cooling liner of the associated one of the cylinders via at least one transition channel, the transition channels of at least two of the cylinders are directly connected via a pressure compensation chamber, and a flow path of a coolant for each cylinder extends from the at least one separate cooling chamber of the cylinder head to the cooling liner of the cylinder.

2. The liquid-cooled internal combustion engine according to claim 1, wherein the pressure compensation chamber is integrated in the engine block, said pressure compensation chamber extending especially in a longitudinal direction of the engine block and abutting tangentially on the cooling liners of the cylinders.

3. The liquid-cooled internal combustion engine according to claim 1, wherein a distributing chamber is provided, which is adapted to be connected to an external pressure source via a pressure connection and which communicates with the at least one separate cooling chamber of each of the cylinder heads via at least one channel, so that the coolant can flow from the distributing chamber into the at least one separate cooling chamber.

4. The liquid-cooled internal combustion engine of claim 3, wherein the distributing chamber is integrated in the engine block.

5. The liquid-cooled internal combustion engine according to claim 1, wherein at least one collecting chamber is provided, which is connected to the cooling liner of each of the cylinders via one or a plurality of channels, so that the coolant can flow from each of the cooling liners of the engine block into the collecting chamber.

6. The liquid-cooled internal combustion engine of claim 5, wherein the collecting chamber is integrated in the engine block.

7. The liquid-cooled internal combustion engine according to claim 1, wherein at least two transition channels are provided per cylinder head, said at least two of the transition channels extending in parallel from the cylinder head.

8. The liquid-cooled internal combustion engine according to claim 7, wherein said at least two of the transition channels extend from the at least one cooling chamber to the pressure compensation chamber.

9. The liquid-cooled internal combustion engine according to claim 1, wherein a main flow path of the coolant for each of the cylinders extends from a distributing chamber via an upper cooling subchamber into a lower cooling subchamber, from where it extends via the at least one transition channel to the pressure compensation chamber, and from the pressure compensation chamber via the cooling liner into a collecting chamber.

10. The liquid-cooled internal combustion engine according to claim 1, wherein a main flow path of the coolant for each of the cylinders extends from a distributing chamber via a lower cooling subchamber into an upper cooling subchamber, from where it extends via the at least one transition channel to the pressure compensation chamber, and from the pressure compensation chamber via the cooling liner into a collecting chamber.

11. The liquid-cooled internal combustion engine according to claim 1, wherein the cylinder heads define a cylinder bank, which is produced as a cast part, at least a part of the separate cooling chambers communicating with one another via a vent line integrated in the cylinder heads and the cylinder bank.

12. The liquid-cooled internal combustion engine according to claim 1, wherein gasket elements of cylinder head gaskets through which partial flows of the flow a path of the coolant between each of the cylinder heads and the engine block flow are configured identically for all the cylinders.

13. The liquid-cooled internal combustion engine according to claim 1, wherein each of the cooling liners is subdivided into at least two cooling subliners, and the cooling subliners are connected in parallel to the pressure compensation chamber and/or a collecting chamber.

14. The liquid-cooled internal combustion engine according to claim 13, wherein a connection exists between the cooling liners of neighboring cylinders.

15. The liquid-cooled internal combustion engine of claim 13, wherein each of the cooling liners is subdivided into a lower and an upper cooling subliner.

16. A liquid-cooled internal combustion engine comprising an engine block, which includes a plurality of cylinders, and cylinder heads closing the cylinders, wherein each of the cylinders is surrounded by a respective cooling liner, each of the cylinder heads has provided therein at least one separate cooling chamber connected to the cooling liner of the associated cylinder via at least one transition channel, the transition channels of at least two of the cylinders are directly connected via a pressure compensation chamber, and at least two of the separate cooling chambers are provided for each of the cylinder heads, and are interconnected via at least one connection channel.

17. The liquid-cooled internal combustion engine according to claim 16, wherein at least one exhaust duct extending through each of the cylinder heads is, at least sectionwise, fully surrounded by the separate cooling chambers of the cylinder head, as well as the connection channels.

18. The liquid-cooled internal combustion engine according to claim 16, wherein an upper and a lower cooling subchamber are provided.

19. The liquid-cooled internal combustion engine of claim 18, wherein at least one exhaust duct extending through each of the cylinder heads is fully surrounded by the upper and the lower cooling subchambers.

20. The liquid-cooled internal combustion engine according to claim 16, wherein the at least two of the separate cooling chambers are interconnected via at least two of the connection channels with different diameters.

21. A liquid-cooled internal combustion engine comprising an engine block, which includes a plurality of cylinders, and cylinder heads closing the cylinders, wherein each of the cylinders is surrounded by a respective cooling liner, each of the cylinder heads has provided therein at least one separate cooling chamber connected to the cooling liner of the associated cylinder via at least one transition channel, the transition channels of at least two of the cylinders are directly connected via a pressure compensation chamber, and at least one bypass extends from at least one of the separate cooling chambers of each of the cylinder heads, and terminates in a collecting chamber, to provide a bypass flow path that circumvents the cooling liner.

22. The liquid-cooled internal combustion chamber of claim 21, wherein said at least one bypass extends from a lower cooling subchamber.

* * * * *